United States Patent [19]

Lamoure

[11] Patent Number: 4,550,536

[45] Date of Patent: Nov. 5, 1985

[54] INDUSTRIAL BUILDING FRAMEWORK FORMED FROM PREFABRICATED REINFORCED CONCRETE ELEMENTS

[76] Inventor: Jean F. Lamoure, 30, rue Montaigne, 47000 Agen, France

[21] Appl. No.: 444,017

[22] Filed: Nov. 23, 1982

[30] Foreign Application Priority Data

Nov. 23, 1981 [FR] France ..... 81 21902

[51] Int. Cl.[4] ..... E04B 7/02

[52] U.S. Cl. ..... 52/91; 52/252; 52/259

[58] Field of Search ..... 52/251, 252, 259, 643, 52/204, 250, 253, 648, 721, 722, 664

[56] References Cited

U.S. PATENT DOCUMENTS

| | | | |
|---|---|---|---|
| 1,031,079 | 7/1912 | Meier | 52/259 |
| 1,088,676 | 3/1914 | Anderson | 52/250 |
| 4,328,651 | 5/1982 | Gutierrez | 52/252 X |

FOREIGN PATENT DOCUMENTS

| | | | |
|---|---|---|---|
| 2273913 | 1/1976 | France | 52/252 |

*Primary Examiner*—Carl D. Friedman
*Assistant Examiner*—Catherine Smith
*Attorney, Agent, or Firm*—William A. Drucker

[57] ABSTRACT

A building framework is provided characterized by an assembly of ridge beams (2–3–4) and rectilinear concrete stringers (1–5) forming with rectilinear half-trusses (6 to 13) a network supported by concrete posts (14 to 19) some at least of the nodes of said network and, advantageously, one node out of two along each beam, not comprising the post, the terminal portion of each of the half-trusses which such a node without post comprises resting in a trough integral with one face of the beam whereas, at each of the nodes which comprises a post, the head of this latter (18) is provided with two vertical rabbets disposed in the form of a cross in which are engaged respectively the terminal portions of the half-trusses and the beam which extends to said node, continuity elements being provided in the terminal portions of the half-trusses and in the beam to provide the mechanical connections at the locations of the nodes.

4 Claims, 2 Drawing Figures

INDUSTRIAL BUILDING FRAMEWORK FORMED FROM PREFABRICATED REINFORCED CONCRETE ELEMENTS

OBJECT OF THE INVENTION

The invention relates to buildings and more particularly to those intended for industrial and commercial uses.

It provides a framework formed from a small number of types of prefabricated concrete elements, of rectilinear form, so relatively easy to transport. This framework, intended for receiving the roofing, possibly with the use of purlins, presents with respect to the metal frameworks often used in industrial buildings, the advantages inherent to concrete (resistance to deterioration, stability to fire, etc.), while being competitive because of its special structural features, insofar as the price of manufacture and fitting is concerned. Furthermore, it presents an attractive esthetic appearance, and, since it uses a relatively reduced number of posts, leaves the ground free over large areas.

According to the invention, this framework is principally characterized by an assembly of concrete ridge beams and rectilinear stringers forming with rectilinear half-trusses a network supported by concrete posts, some at least of the nodes of said network and, advantageously, one node out of two along each beam not comprising any post, the terminal portion of each of the half-trusses which such a node without post comprises resting in a trough integral with one face of the beam, whereas, at each of the nodes which comprise a post, the head of this latter is provided with two vertical rabbets disposed in the form of a cross in which are engaged respectively the terminal portions of the half-trusses and of the beams which extend to said node, one of these two rabbets being possibly replaced by two troughs, continuity elements being provided in the terminal portions of the half-trusses and of the beams to provide the mechanical connections at the locations of the nodes.

BRIEF DESCRIPTION OF THE DRAWING

Other particularities, as well as the advantages of the invention, will clearly appear from the following description.

In the accompanying drawing.

DESCRIPTION OF THE PREFERRED EMBODIMENT

Figure 1:
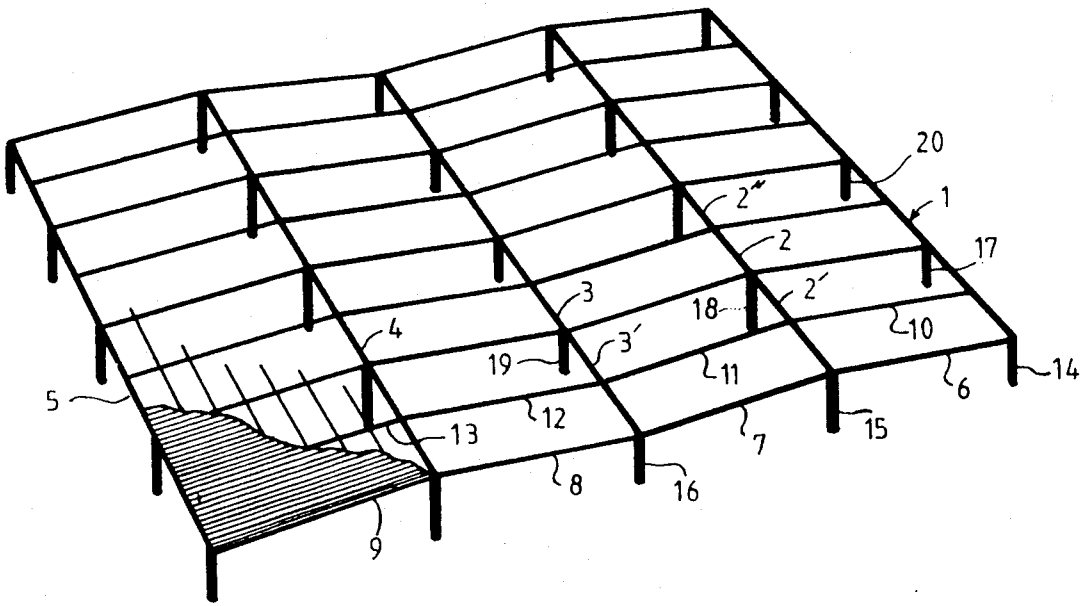
FIG. 1 is a perspective view of a building framework in accordance with one preferred embodiment of the invention.

The framework shown in FIG. 1 is, by way of example, intended for the construction of a rectangular shop 80 m long and 48 m wide. It is formed from ridge beams 2–3–4 and stringers 1–5 and transverse half-trusses made from reinforced concrete such as 6–7–8–9, 10–11–1-2–13, supported by reinforced concrete posts such as 14 to 19.

Each of the two gable walls comprise, for example, a post 14–15–16 every 20 m whereas each of the two long walls comprises a post, such as 14–17–20, every 12 m.

It can be seen that, according to an important feature of this framework, along a longitudinal beam 1 to 5, in the gap between two posts 15–18, there is a row of half-trusses. Two or three rows of half-trusses could, moreover, be provided in this gap.

In short, each half-truss spans, without any support, a gap of about 20 m and all the supports of one half-truss out of two or more (such as 10 or 11) are formed without post and result from assembly with a longitudinal beam.

The important advantage of this structure is that the ground of each of the 12×20 m frame spacers only comprises a post at each corner, without any central or intermediate post. Besides freeing the ground, the reduction of the number of posts obviously results in savings.

Since the half-trusses are straight pieces with out-of-level support, they develop no horizontal thrust at their ends, despite their slope: that makes it possible to do away with the posts at certain nodes.

Figure 2:
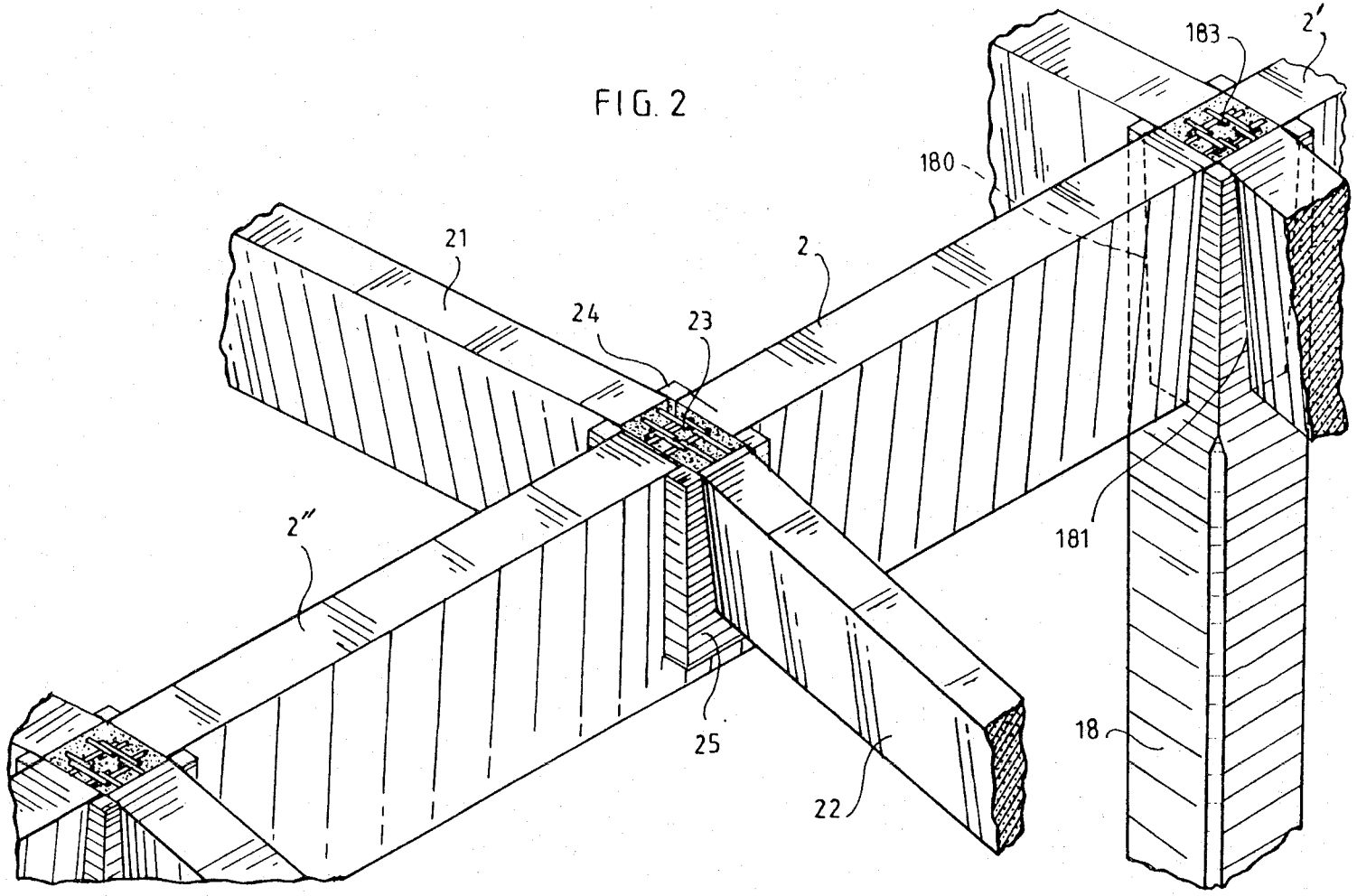
FIG. 2 is a perspective view of three nodes of the framework, two of which comprise a post.

As is shown in FIG. 2, the assembly between the longitudinal beam 2–2″ and two half-trusses 21–22 is achieved by means of an anchorage 23 formed from iron bars welded together and respectively integral with the facing ends of the two half-trusses and with the two opposite edges of a recess formed in the beam. These bars may be rectilinear and welded, as in the case of the figure, or in the form of traditional anchoring groups, or similar and they are covered with a protecting concrete forelock which builds up the recess.

Troughs 24–25, advantageously made from concrete and integral with the two respective faces of the beam, receive the ends of the half-trusses 21–22, which are thus correctly positioned in the extension of each other and cannot rotate laterally after fitting. These troughs are subject to no lateral thrust.

The assembly between the beams (portion 2–2′) and the two half-trusses corresponding to a node which comprises a post 18 takes place in the following way:

The head of the beam is provided with two vertical rabbets 180–181, orthogonal with respect to each other and trapezoidal in section, and whose bottom (small base of the trapezium) has a width which corresponds respectively to the width of a beam and to that of a half-truss. The height of the rabbet 180 corresponds to that of a beam, whereas the height of the rabbet 181 corresponds to that of a half-truss. The connections between the beam and the half-trusses is provided, as for nodes without posts, by means of bars such as 183 protected by a concrete coating. These rabbets transmit the vertical load to the post and guide the beam (or the half-truss) which, once placed in position, cannot rotate.

In some cases, for the sake of convenience, a rabbet may be replaced by two troughs.

It should be noted that the dimensions of the frame spaces given by way of example are in no wise limiting and that the slopes of the beams and of the half-trusses may have any value and signs. Similarly, the number of the half-trusses fixed to the same beam will vary depending on the project.

We claim:

1. A framework for receiving a slanted roofing of a building, said framework comprising an assembly of prefabricated reinforced concrete elements substantially parallelepipedic in shape, said assembly including:

a plurality of pairs of vertical posts, each post comprising an upper end provided with a substantially horizontal supporting surface, said pair of vertical posts defining a first vertical plane;

a horizontal ridge beam, having a longitudinal axis, first and second vertical opposite faces and upper and lower horizontal opposite faces, and lower horizontal face bearing on said supporting surfaces of said posts and said horizontal upper face being provided with at least two transversal recesses perpendicular to said longitudinal axis and reinforcement bars incorporated in said horizontal beams and passing through said transversal recesses;

at least two slanted roof truss structures respectively extending in second and third spaced vertical planes perpendicular to said longitudinal axis, each of said roof truss structures comprising a first slanted half roof truss having a first upper extremity with a first upper substantially vertical face bearing on a first portion of said opposite face of said horizontal ridge beam, and a second slanted half roof truss comprising a second upper extremity with a second substantially vertical upper end face bearing on a second portion of the second opposite face of said horizontal ridge beam, said upper end faces of the first and second half roof trusses, each having an upper part located in front of one corresponding of said two recesses, said half roof trusses further comprising reinforcement bars incorporated therein, which have end portions extending beyond said respective upper parts into said corresponding recess, the two half roof trusses of each slanted roof truss structure being symmetrical relative to said first vertical plane;

connecting means for at least said end portions of the reinforcement bars of the first and the second half roof trusses, whereby the horizontal thrusts developed by the two half slanted roof trusses of each slanted roof truss structure produce both a counterbalanced pulling force on the corresponding reinforcement bars and a counterbalanced compressional force on the corresponding first and second portions of the horizontal ridge beam;

a protecting concrete forelock building up said recesses a plurality of rectilinear horizontal stringers supported by said half roof trusses and extending parallel to said ridge beam.

2. A framework according to claim 1, in which said first and second portions of said first and second opposite faces of said corresponding horizontal ridge beam each comprise a concrete trough integral with said beam, in which is engaged the upper extremity of a corresponding half roof truss.

3. A framework according to the claim 1, in which each of said posts has a head provided with first and second vertical rabbets disposed in the form of a cross, i.e. a first rabbet traversed through and through by one corresponding horizontal ridge beam and a second rabbet, said ridge beam delimiting in said second rabbet two cavities respectively adjacent to said first and second portions of the two opposite faces of the ridge beam, each of said cavities receiving the upper extremity of a corresponding half roof truss.

4. A framework according to claim 1, in which said connecting means further comprise means for connecting said end portions of the reinforcement bars of the half roof trusses to the reinforcement bars of the horizontal ridge beam which passes through said transversal recess.

* * * * *